US007661982B2

(12) United States Patent
Tachi et al.

(10) Patent No.: US 7,661,982 B2
(45) Date of Patent: Feb. 16, 2010

(54) CONNECTOR

(75) Inventors: Hideshi Tachi, Yokkaichi (JP); Masaya Horiuchi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/203,950

(22) Filed: Sep. 4, 2008

(65) Prior Publication Data

US 2009/0093153 A1 Apr. 9, 2009

(30) Foreign Application Priority Data

Oct. 4, 2007 (JP) ..... 2007-260821

(51) Int. Cl.
*H01R 13/58* (2006.01)

(52) U.S. Cl. ..... 439/471

(58) Field of Classification Search ..... 439/610, 439/471, 464, 470, 460, 95, 97, 451; 174/74 R, 174/74 A, 79, 80, 89, 84 R, 88 R
See application file for complete search history.

(56) References Cited

U.S. PATENT DOCUMENTS 5,055,066 A * 10/1991 Garretson ..... 439/464
6,162,087 A * 12/2000 Hiura ..... 439/521
6,186,451 B1 * 2/2001 Benoit ..... 248/74.3
7,210,964 B2 * 5/2007 Morris et al. ..... 439/610

FOREIGN PATENT DOCUMENTS

JP 11-329575 11/1999

* cited by examiner

*Primary Examiner*—Edwin A. Leon
(74) *Attorney, Agent, or Firm*—Gerald E. Hespos; Anthony J. Casella

(57) ABSTRACT

A rubber boot (30) is fit on a peripheral surface of a connector housing (10). Wires (90) pulled out of a rear surface of the housing (10) are folded back midway, and a folded region of the electric wires (90) is disposed along a peripheral surface of the boot (30). In this state, a tightening member (50) is tightened to the peripheral surface of the boot (30) to fix the wires (90) and the housing (10) together. A positioning portion (36) for regulating a longitudinal position of the tightening member (50) is provided on the peripheral surface of the boot (30). The phase of the wires (90) and the housing (10) become almost equal to each other when the connector is subjected to vibration. Therefore it is possible to prevent the terminal fittings (60) from vibrating inside the housing (10).

8 Claims, 5 Drawing Sheets

CONNECTOR

BACKGROUND OF THE INVENTION

1. Field of the Invention

The invention relates to a connector.

2. Description of the Related Art

A prior art connector has a housing that accommodates terminal fittings. The terminal fittings are connected with wires that are pulled out from a rear end of the housing. A connector mounted on a vehicle is subjected to vibrations, and wires pulled out of the rear end of the housing vibrate in a direction orthogonal to their axial direction due to vibrations in the periphery of the connector. The terminal fittings also vibrate and may rub against mating terminal fittings to produce wear.

Japanese Patent Application Laid-Open No. 11-329575 attempts to solve the above-described problem by employing a tightening member. More particularly, a wiring-forcing member is locked elastically to the rear surface of the housing. Wires pulled out of the rear surface of the housing are disposed axially on convex and concave portions formed on the wiring-forcing member. A tie band is tightened to the concave portion from above to press the electric wires against the concave portion so that the electric wires are fixed wavily.

The housing and the wiring-forcing member of the above-described connector are formed separately and are coupled longitudinally only through the locks of the housing and the wiring-forcing member. Vibrations on the periphery of the housing may loosen the wiring-forcing member from the housing. Consequently the wires inside the wiring-forcing member vibrate, and the vibration is transmitted to the terminal fittings. Thus, there is a fear that the terminal fittings will wear.

The invention has been completed in view of the above-described situation. Therefore it is an object of the invention to prevent a terminal fitting from being worn

SUMMARY OF THE INVENTION

The invention relates to a connector with a housing for accommodating terminal fittings. The terminal fittings are connected respectively with electric wires pulled out of a rear of the housing. The wires are folded back towards the front end of the housing. A tightening member is tightened to a peripheral surface of the housing from an outer side and in a direction orthogonal to pull-out direction of wires so that the pulled out wires are disposed along a peripheral surface of the housing. Thus, the wires and the housing are fixed to each other. A positioning portion regulates a longitudinal position of the tightening member on the housing. Thus, vibrational phases of the wires and the housing are almost equal to each other when the periphery of the connector is subjected to vibration. Consequently, the terminal fittings in the housing will not vibrate and wear even though the wires vibrate. Further the wires are tightened and fixed to the peripheral surface of the housing. Therefore, the connector is not large in the longitudinal direction The positioning portion preferably is on the outer periphery of the housing so that the tightening member can be tightened easily. Further, the tightening member preferably has a large radius of curvature. Therefore, a large gap is not be generated between the positioning portion and the tightening member and the wires are fixed stably to the housing.

A rubber boot preferably is mounted on the peripheral surface of the housing and wraps entirely around the peripheral surface of the housing. The positioning portion preferably is on a peripheral surface of the boot. Thus, the construction of the housing need not be complicated by the positioning portion. Further the boot is versatile and can be used for a plurality of housings.

A flexible belt preferably extends from a main body of the boot and the positioning portion preferably is part of the belt. The belt is wound round a peripheral surface of the main body from the outer side and holds the wires against the peripheral surface of the main body. The belt is made of rubber and is interposed between the wires and the tightening member. Thus, the wires will not be damaged by tightening of the tightening member.

The housing preferably has a cylindrical hood and the positioning portion is at a longitudinal middle portion of a peripheral surface of the hood. Therefore, the hood is not likely to be deformed by tightening the tightening member.

DETAILED DESCRIPTION OF THE PREFERRED EMBODIMENTS

Figure 1:
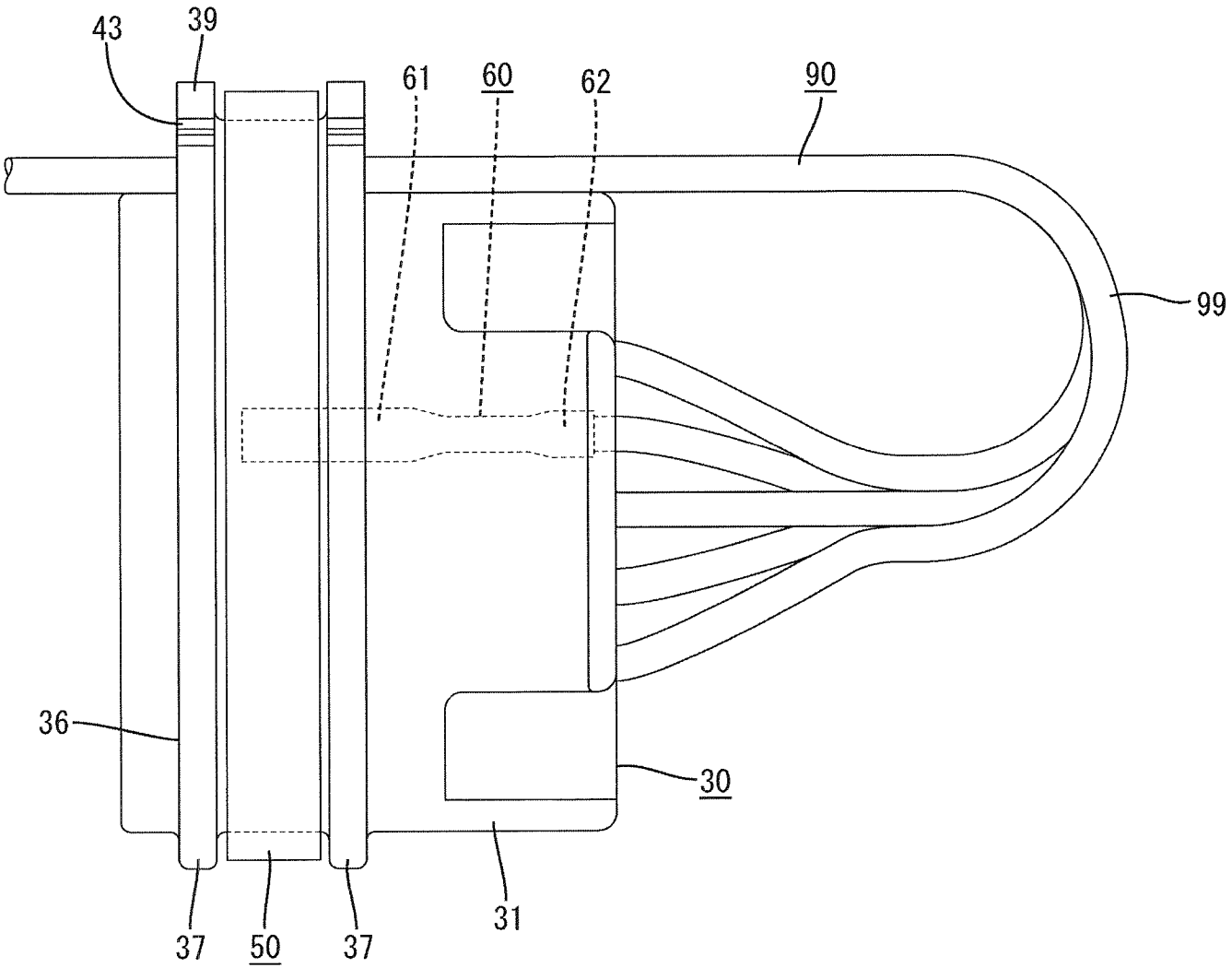
FIG. 1 is a side view of a connector in accordance with the invention.
Figure 2:
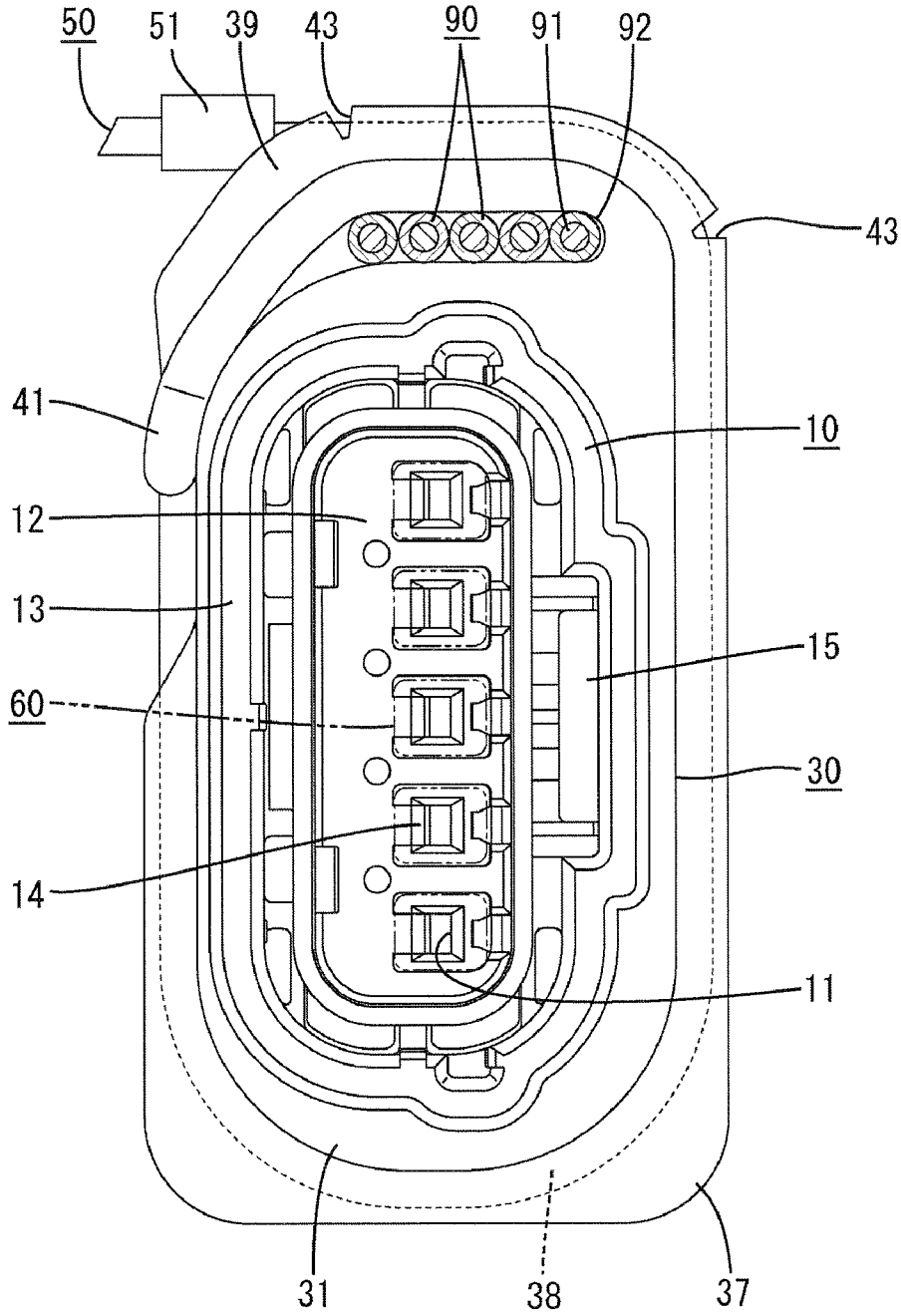
FIG. 2 is a front view of the connector.

A connector in accordance with the invention has a housing 10, a boot 30, a tightening member 50, terminal fittings 60 and wires 90, as shown in FIGS. 1 and 2. The housing 10 can be fit in a mating housing (not shown in the drawings) directly coupled to a kiki. The terminal fittings 60 connect electrically with corresponding mating terminal fittings (not shown in the drawings) in the mating housing when the housings are connected. In the description made below, the end at which the housing 10 is fit in the mating connector is referred to as the front end, and the vertical direction is based on that of FIG. 1.

The housing 10 is made of a synthetic resin and is vertically long and narrow, as shown in FIG. 2. The housing 10 has a terminal accommodation part 12 with cavities for accommodating terminal fittings 60 and a hood 13 surrounds the periphery of the terminal accommodation part 12. The mating housing can be fit between the terminal accommodation part 12 and the hood 13. Cavities 11 are disposed in a vertical row in the terminal accommodation part 12. Lances 14 are formed in inner walls of the cavities 11 and are configured to hold the respective terminals fitting 60 in the cavities 11. A holding portion 15 projects from one of the longer side surfaces of the housing 10 for holding the housing 10 and the mating housing in a fit-in state.

The terminal fitting 60 is formed by bending a conductive metal plate. As shown in FIG. 1, the terminal fitting 60 includes of a cylindrical box 61 and a barrel 62. The box 61 is configured to connect to a mating terminal fitting. The barrel 62 is rearward from the box 61 and is caulked to an end of the electric wire 90. The electric wire 90 has a conductive core wire 91 and an insulating coating 92 disposed on the periphery of the core 92.

Figure 3:
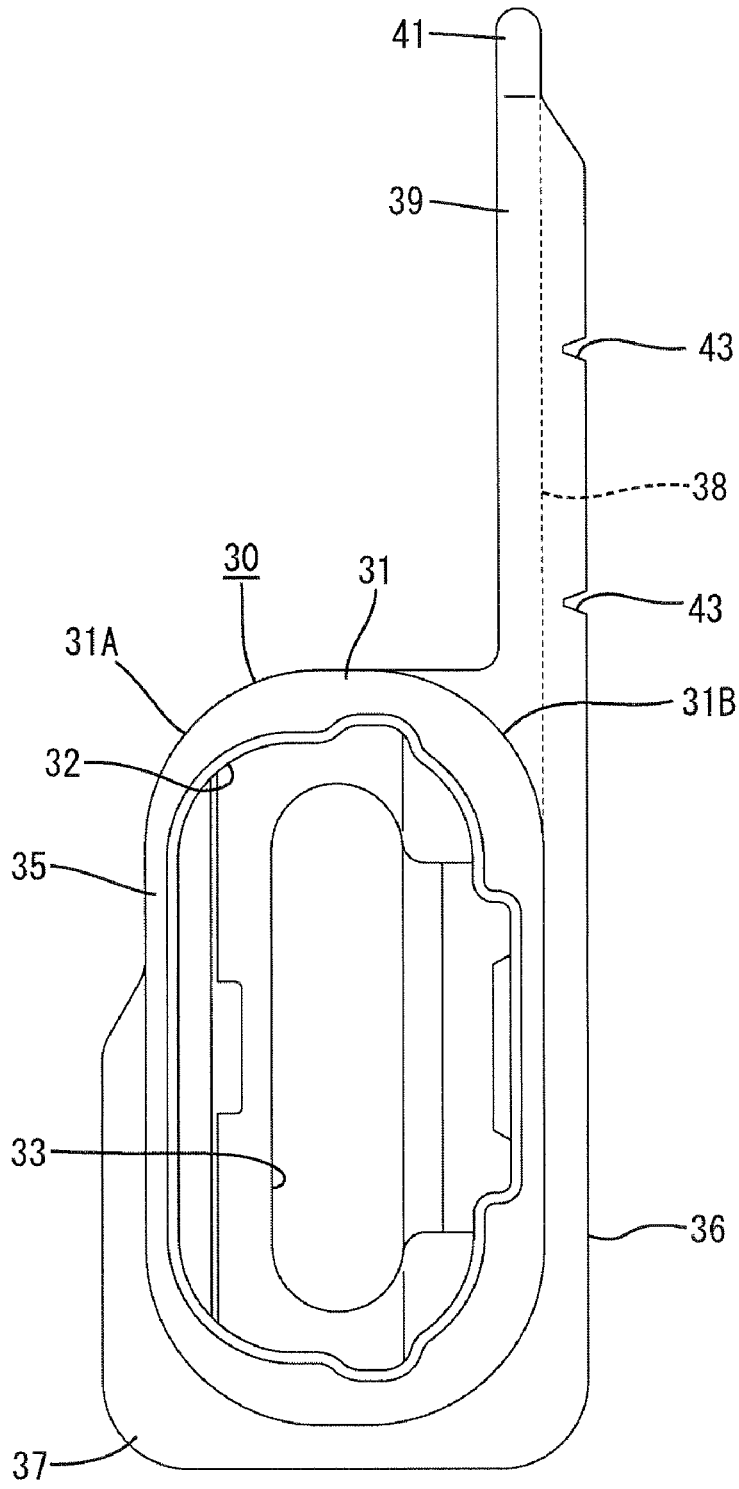
FIG. 3 is a front view of a boot.
Figure 4:
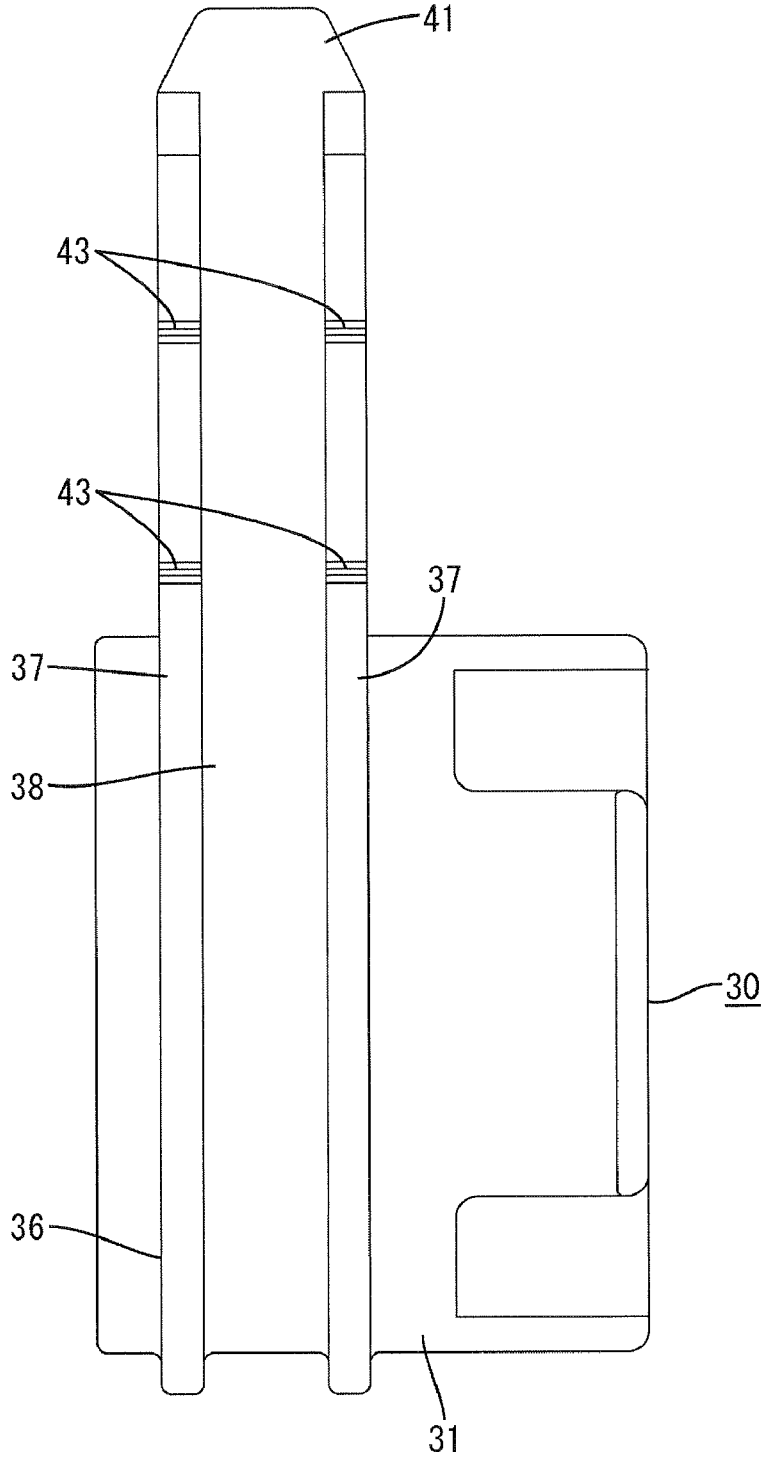
FIG. 4 is side view of the boot.
Figure 5:
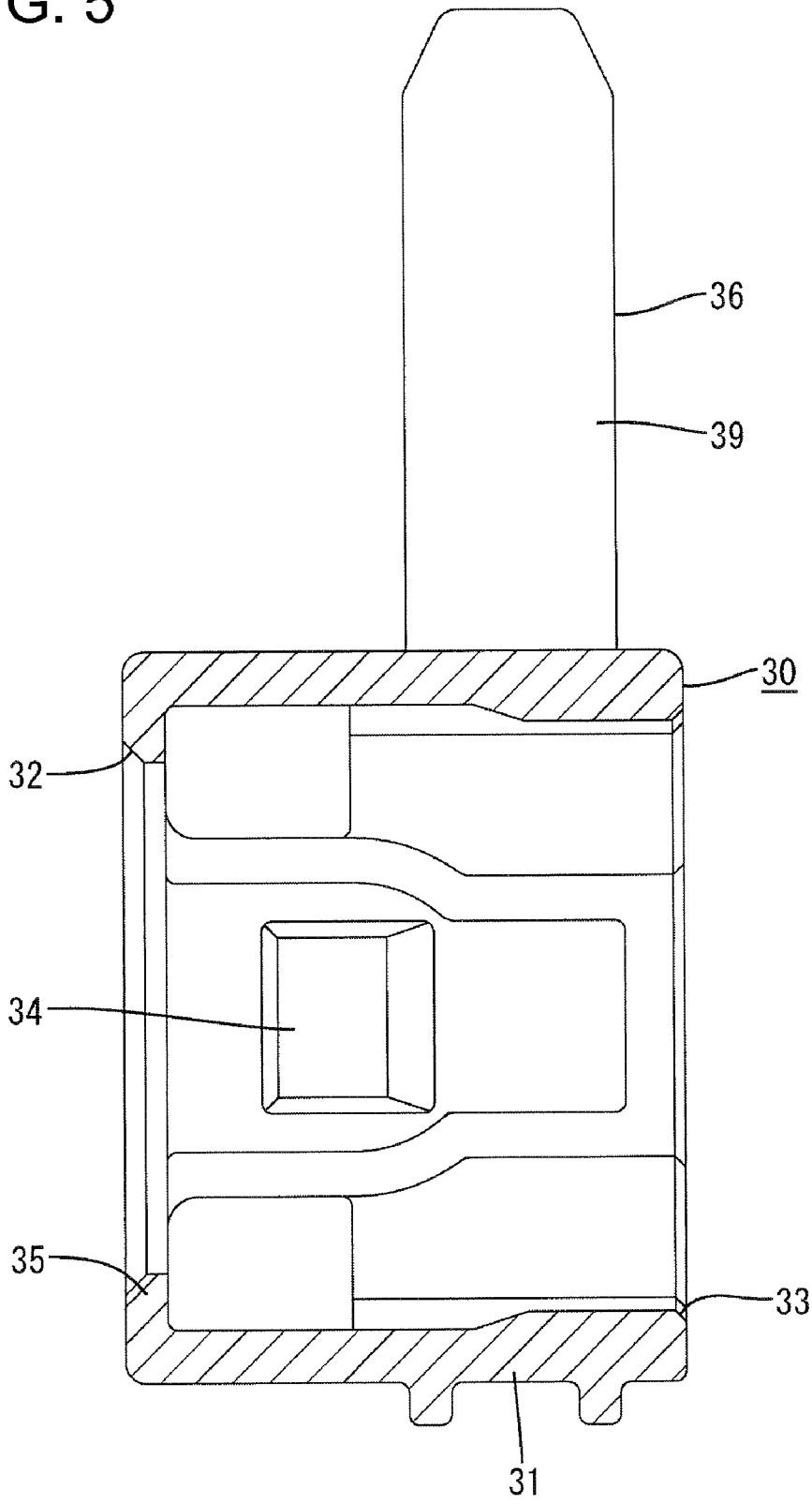
FIG. 5 is a side view of the boot partly in section.

The boot 30 is made of rubber. As shown in FIGS. 3 through 5, the boot 30 has a tubular main body 31 with open front and rear ends. The main body 31 can cover the entire peripheral surface of the housing 10 except for the front and rear ends thereof. A fit-in surface 32 is formed at the open front end of the main body 31 and can fit in the mating housing. The rear open portion of the main body 31 defines a pull-out surface 33 for each electric wire 90 to be pulled out of the rear surface of the housing 10. A concave portion 34 is provided on an inner surface of the main body 31 for receiving the holding portion 15. A flange 35 projects in at the front of the main body 31 and closely contacts the edge of the open front of the hood 13.

A positioning portion 36 is provided at a longitudinal middle portion of the peripheral surface of the main body 31 and can be disposed circumferentially around the main body 31. Front and rear ribs 37 project from the peripheral surface of the main body 31 and an annular groove 38 is disposed between the ribs 37 for receiving the tightening member 50. The ribs 37 are parallel and extend circumferentially to the longitudinal direction of the main body 31, except for the left corner 31A in FIG. 3. The width of the annular groove 38 is slightly larger than a maximum longitudinal length of the tightening member 50. A bottom surface of the annular groove 38 is disposed along a plane surface having almost the same height as the peripheral surface of the main body 31 disposed outside the annular groove 38.

A flexible belt 39 extends from the upper right corner 31 B of the main body 31. The belt 39 constitutes a part of the positioning portion 36 and has the annular groove 38 and both ribs 37 continuous with the positioning portion 36 of the main body 31. The belt 39 is can be wound around the main body 31 to achieve close contact with the main body 31 in a region from the upper shorter side of the peripheral surface of the main body 31 to a portion of the longer side surface of the peripheral surface thereof. The ribs 37 extend along the belt 39 from a position spaced a short interval from the leading end. Only a bottom portion 41 of the annular groove 38 is formed at the leading end portion of the belt 39. The bottom portion 41 becomes smaller toward its leading end in the longitudinal length thereof and is deformable when the belt-shaped piece 39 is curved.

The boot 30 is used by bending the belt 39 around the peripheral surface of the main body 31 from a joint between the belt 39 and the main body 31 while wrapping the electric wires 90 therein. Thus, the belt 39 and the positioning portion of the main body 31 become annularly continuous with each other to form the positioning portion 36 formed on almost the entire circumference of the main body 31. Approximately V-shaped notches 43 are formed at projected ends of both ribs 37 of the belt 39 for allowing an operation of winding the belt 39 to be performed smoothly. The notches 43 are formed on the belt 39 at positions that deform a large amount due to the winding of the belt 39 around the main body 31. More specifically, notches 43 are formed on the belt 39 in a joint between belt 39 and the main body 31 corresponding to the upper right corner 31B and in a region corresponding to the upper left corner 31A.

The tightening member 50 is a flexible tie band with a width slightly smaller than width of annular groove 38 and a length to wrap around the peripheral surface of the main body 31. A lock 51 is provided at one end of the tightening member 50 and is configured to receive the other end of the tightening member 50. A large number of saw-shaped to-be-locked portions (not shown in the drawings) are formed at longitudinally spaced positions near the other end of the tightening member 50. A multistep adjustment of the tightening amount of the tightening member 50 is achieved by altering the position at which the lock 51 locks the to-be-locked portion.

The boot 30 is fit on the housing 10 from the rear end. As a result, the inner peripheral surface of the boot 30 covers and closely contacts the outer peripheral surface of the housing 10, and the electric wires 90 are pulled out of the rear surface of the housing 10 through the pull-out surface 33 of the boot 30.

The electric wires 90 pulled out of the housing 10 are bundled and are folded back midway approximately in a U-shape so that the tips of the folded electric wires 90 are directed towards the housing 10. Thus, the folded region of the wires 90 is turned from the rear surface of the boot 30 (housing 10) to the front end thereof and is disposed along the peripheral surface of the boot 30. The annular tightening member 50 then is fit loosely on the annular groove 38 of the positioning portion 36 from the outer side and is tightened strongly around the annular groove 38 from the outer side. As a result, the diameter of the tightening member 50 becomes small along the annular groove 38, and the belt 39 is curved while wrapping the folded region of the electric wires 90 therein. Consequently the leading end of the belt 39 is brought into close contact with the peripheral surface of the main body 31 (see FIGS. 1 and 2). The tightening member 50 is guided by the ribs 37 during the tightening operation. The ribs 37 restrain the tightening member 50 from moving longitudinally while tightening the tightening member 50, and the tightening member 50 closely contacts the bottom surface of the annular groove 38 with the tightening member 50 cutting therein. The locking operation performed between the lock 51 and the to-be-locked portion prevents the tightening member 50 from loosening. Thus, the tightening member 50 fixes the electric wires 90 tightly to the main body 31 of the boot 30 at the side of housing 10. In the tightened state, a U-shaped region 99 ranging from the pull-out position of the electric wires 90 to the tightening position engages the housing 10 and vibrates in tune with the housing 10.

A vibration generated while the housing 10 is fit on the mating housing is transmitted to the housing 10, and the housing 10 vibrates. At this time, the electric wires 90 in the U-shaped region 99 pulled out of the rear of the housing 10 vibrate in tune with the vibration of the housing 10. Therefore, the positions of the wires 90 will not fluctuate relative to the housing 10 and the terminal fittings 60 connected with the wires 90 will not loosen in the housing 10. The mating housing vibrates in tune with the vibration on the periphery thereof. The phase of the vibration of the mating housing is almost equal to that of the housing 10. Thus, the position of the mating terminal fitting will not fluctuate relative to the positions of the terminal fitting 60 and the mating terminal fitting and the terminal fitting 60 will not rub against each other.

As described above, the tightening member 50 tightens the wires 90 pulled out of the rear of the housing 10 and fixes the wires 90 to the peripheral surface of the housing 10. Therefore, vibrational phases of the wires 90 and the housing 10 become almost equal to each other. Consequently, the terminal fittings 60 connected with the wires 90 will not vibrate in the housing 10 and the terminal fittings 60 will not wear. Further the wires 90 are tightened and fixed to the peripheral surface of the boot 30 mounted on the peripheral surface of the housing 10. Therefore, the connector is not long.

The positioning portion 36 is provided circumferentially on the peripheral surface of the boot 30. This construction allows the tightening member 50 to be tightened more easily than a construction where the positioning portion 36 is provided locally on the boot 30. Further, the radius of curvature of the tightening member 50 is large. Hence, hardly any gap is generated between the positioning portion 36 and the tightening member 50 so that the wires 90 are fixed stably to the housing 10.

The positioning portion 36 is provided on the boot 30. Therefore, the construction of the housing 10 is simplified. Further the boot 30 can be used for a plurality of housings 10 and exhibits excellent versatility.

The rubber belt 39 of the tightening member 50 tightens the wires 90 pulled out of the housing 10. Thus, the wires 90 will not be damaged by tightening the tightening member 50. Additionally, the number of parts is decreased because the belt 39 is constructed unitarily with the boot 30.

The positioning portion 36 is at a longitudinal middle portion of the peripheral surface of the hood 13. Therefore compared with a construction where the positioning portion 36 is provided at the front opening edge of the hood 13, it is possible to secure a necessary strength and prevent the hood 13 from being deformed by tightening the tightening member 50.

The invention is not limited to the above-described embodiment described above with reference to the drawings. For example, the following embodiments are included in the technical scope of the present invention.

The invention is applicable to the case where the boot is not mounted on the peripheral surface of the housing. In this case, it is preferable to provide the positioning portion directly on the peripheral surface of the housing.

The positioning portion may be partly on the peripheral surface of the housing. For example, the positioning portion may be a U-shaped handle projected from the peripheral surface of the housing.

The portion of each wire pulled out of the rear of the housing may be covered with a bellows-shaped portion continuous with the main body of the boot.

The belt-shaped piece may be omitted and the wires pulled out of the rear surface of the housing are tightened directly by the tightening member.

The positioning portion may be near the rear wall of the hood to prevent the hood from being deformed by the tightening of the tightening member.

What is claimed is:

1. A connector comprising:

a housing capable accommodating terminal fittings therein, the housing have an outer peripheral surface;

electric wires pulled out of a rear surface of said housing, with said electric wires connected with said terminal fittings respectively, the electric wires being folded back toward a front end of the housing;

a rubber boot with a main body mounted entirely around said outer peripheral surface of said housing, at least one positioning portion provided on an outer peripheral surface of the main body of the rubber boot and a flexible belt extending from the main body and being wound at least partly around the main body of the rubber boot for holding the electric wires between the flexible belt and the main body of the rubber boot; and a tightening member tightened around the flexible belt and at least a portion of the peripheral surface of said main body of the rubber boot from an outer side, the tightening member being substantially adjacent the positioning portion provided on said peripheral surface of said main body of said rubber boot for regulating a longitudinal position of said tightening member.

2. The connector of claim 1, wherein said positioning portion extends at least partly around the outer peripheral surface of said main body of the rubber boot.

3. The connector of claim 1, wherein said housing has a tubular hood; said positioning portion being aligned with a longitudinal middle of said hood.

4. A connector comprising:

a housing having opposite front and rear ends and an outer peripheral surface extending between the ends;

terminal fittings mounted in the housing;

electric wires connected respectively with the terminal fittings and pulled out from rear the end of the housing, the electric wires including a fold in proximity to the rear end of the housing and a folded portion forward of the fold and substantially adjacent the outer peripheral surface of the housing;

a rubber boot with a main body mounted entirely around the outer peripheral surface of the housing, the main body of the rubber boot having an outer peripheral surface, a positioning portion projecting out of the outer peripheral surface of the main body of the rubber boot a flexible belt extending from the main body, the belt being wound at least partly around the main body for holding portions of the wires between the belt and the outer peripheral surface of the main body;

a tightening member tightened around said main body of the rubber boot for holding the folded portion of the electric wires between the outer peripheral surface of said main body and the tightening member; and whereby the positioning portion regulates a longitudinal position of the tightening member.

5. The connector of claim 4, wherein the positioning portion extends at least partly around the outer peripheral surface of the main body.

6. A connector comprising:

a housing having opposite front and rear ends spaced apart along a longitudinal direction, and an outer peripheral surface extending between the ends;

a rubber boot with a main body mounted entirely around the outer peripheral surface of the housing, a flexible belt extending integrally from the main body transverse to the longitudinal direction, two longitudinally spaced ribs formed on an outer peripheral surface of the rubber boot;

terminal fittings mounted in the housing;

wires connected respectively with the terminal fittings and pulled out from rear the end of the housing, the wires including a fold in proximity to the rear end of the housing and a folded portion forward of the fold and disposed between the main body of the rubber boot and the belt thereof; and a tightening member positioned longitudinally between the ribs and being tightened around the housing for holding the folded portion of the electric wires between the outer peripheral surface of the main body and the tightening member, whereby the ribs regulate a longitudinal position of the tightening member.

7. The connector of claim 6, wherein the ribs extend at least partly around the main body of the boot.

8. The connector of claim 7, wherein the ribs extend substantially perpendicular to the longitudinal direction of the housing.

* * * * *